US005369238A

United States Patent [19]

Hirata

[11] Patent Number: 5,369,238

[45] Date of Patent: Nov. 29, 1994

[54] SPRING-RETURN SWITCH

[75] Inventor: Toshihisa Hirata, Furukawa, Japan

[73] Assignee: Alps Electric Co., Ltd., Tokyo, Japan

[21] Appl. No.: 108,203

[22] Filed: Aug. 17, 1993

[30] Foreign Application Priority Data

Aug. 20, 1992 [JP] Japan ..... 4-058530[U]
Aug. 20, 1992 [JP] Japan ..... 4-058531[U]

[51] Int. Cl.[5] ..... H01H 13/14

[52] U.S. Cl. ..... 200/530; 200/531; 200/536

[58] Field of Search ..... 200/530, 531, 520, 536, 200/537, 552, 252, 255, 343, 344

[56] References Cited

U.S. PATENT DOCUMENTS

| | | | |
|---|---|---|---|
| 4,559,427 | 12/1985 | Dolson et al. | 200/343 |
| 4,582,967 | 4/1986 | Brumit et al. | 200/343 |
| 4,827,087 | 5/1989 | Niinuma et al. | 200/5 E |
| 5,008,505 | 4/1991 | Takano et al. | 200/531 |
| 5,201,824 | 4/1993 | Kato et al. | 200/520 |

*Primary Examiner*—Henry J. Recla

*Assistant Examiner*—David J. Walczak

*Attorney, Agent, or Firm*—Guy W. Shoup; Patrick T. Bever

[57] ABSTRACT

A spring-return switch comprises: a case; a common contact embedded in the inner surface of one of the opposite side walls of the case; a transfer contact embedded in the inner surface of the other side wall opposite to the common contact; a slider supported for vertical movement within the case and integrally provided with an operating rod; a movable contact held by the slider and having a base portion held by the slider, a first contact arm in continuous contact with the common contact and a second contact arm to be brought into contact with or to be separated from the transfer contact; and a return spring biasing the slider upward so that the slider is pressed resiliently against the inner surface of the upper wall of the case. The operating rod is dislocated from the center of the slider toward the transfer contact so that most part of pressure applied to the operating rod to depress the slider is exerted on the second contact arm of the movable contact.

4 Claims, 7 Drawing Sheets

SPRING-RETURN SWITCH

BACKGROUND OF THE INVENTION

1. Field of the Invention

The present invention relates to a spring-return switch having a movable contact held on a slider integrally provided with an operating rod, having a first contact arm in continuous contact with a common contact and a second contact arm to be brought into contact with a transfer contact for switching, and to a dual spring-return switch provided with a pair of switch units respectively having sliders integrally provided with operating rods, to be operated selectively for switching and disposed at a specified distance from each other with their operating rods extending in parallel to each other.

2. Description of the Related Art

Referring to FIG. 7 showing a known spring-return switch, a case 1 formed of a synthetic resin is provided integrally with a common contact 2 and a transfer contact 3 embedded respectively in the respective inner surfaces of opposite side walls 1*a* and 1*b* by insert molding, and the common contact 2 and the transfer contact 3 are connected respectively to terminals, not shown, provided externally on the case 1. Contained in the case 1 are a slider 5 formed of a synthetic resin by molding and integrally having a push rod 4 extending through a through hole 1*c* formed in the central portion of the upper wall of the case 1 so as to be axially movable, a movable contact 6 formed by bending a elastic, thin metal plate in a shape substantially resembling the letter U and fixed to the lower end of the slider 5, and a return spring 7 extended between the slider 5 and the lower wall of the case 1 to bias the slider upward. The movable contact 6 has a flat base portion 6*a*, a first contact arm 6*b* and a second contact arm 6*c* extending downward respectively from the opposite ends of the base portion 6*a*. The first contact arm 6*b* is continuously in contact with the common contact 2. Normally, the second contact arm 6*c* is in contact with the inner surface of the side wall 1*b*, as shown in FIG. 7. When the slider 5 is lowered, the second contact arm 6*c* comes into contact with the transfer contact 3.

In FIG. 7, the spring-return switch is in the OFF-state in which the common contact 2 is disconnected from the transfer contact 3. When the push rod 4 projecting upward from the upper surface of the case 1 is depressed by a predetermined distance by an actuator, not shown, to set the spring-return switch in the ON-state, the second contact arm 6*c* comes into contact with the transfer contact 3 to connect the common contact 2 to the transfer contact 3. When the pressure applied to the push rod 4 is removed while the spring-return switch is in the ON state, the compressed return spring 7 pushes up the slider 5 and, consequently, the second contact arm 6*c* is separated from the transfer contact 3 to disconnect the common contact 2 automatically from the transfer contact 3.

FIG. 8 shows a spring-return switch for use on automobiles or the like, in which parts like or corresponding to those described previously with reference to FIG. 7 are denoted by the same reference characters. This spring-return switch is similar in construction and function as the spring-return switch shown in FIG. 7. The spring-return switch shown in FIG. 8 is designed to obviate undesirable, vibratory sliding movement of the movable contact attributable to the vibration of the slider. As shown in FIG. 8, the spring-return switch is provided with a slider 5 provided with a slot, and a movable contact 6 having a base portion 6*a* extending through the slot of the slider 5 with a clearance C between its upper surface and the upper surface of the slot to allow idle movement of the slider 5. If the clearance C is not secured between the slider 5 and the base portion 6*a* of the movable contact 6, the movable contact 6 will vibrate when the slider 5 vibrates to promote the abrasion of the first contact arm 6*b* and the second contact arm 6*c* of the movable contact 6, and a common contact 2, which will deteriorate the performance of the spring-return switch.

Referring to FIGS. 10 and 11 showing a conventional dual spring-return switch having two switch units, a case 11 having a shape substantially resembling a rectangular cuboid is constructed by combining a lower case 12 having opposite longer side walls 12*a* and 12*b*, and an upper case 13 having bosses. A common contact 14 is embedded in the inner surface of the longer side wall 12*a* and a pair of transfer contacts 15 and 16 are embedded in the inner surface of the other longer side wall 12*b* with a space therebetween. Terminals 14*a*, 15*a* and 16*a* projecting outward from the outer surface of the longer side wall 12*a* are connected respectively to the extension of the common contact 14 buried in the longer side wall 12*a* and the extensions of the transfer contacts 15 and 16 buried in the opposite shorter side walls 12*c* and 12*d*. The common contact 14, the transfer contacts 15 and 16, and the terminals 14*a*, 15*a* and 16*a* are combined with the lower case 12 by insert molding. Sliders 17 and 18 integrally provided respectively with operating rods 21 and 22 are supported within the case 11 with the operating rods 21 and 22 extending in parallel to each other respectively through parallel holes 13*a* formed in the bosses of the upper case 13. The upper ends of the operating rods 21 and 22 are inserted respectively in a pair of holes formed in an external device, not shown. In most cases, the interval between the operating rods 21 and 22 is determined on the basis of the center distance between the holes of the standardized external device. A movable contact 19 fixed to the slider 17 has a contact arm continuously in contact with the common contact 14, and another contact arm to be separated from the transfer contact 15 when the operating rod 21 is depressed. A movable contact 20 fixed to the slider 18 has a contact arm continuously in contact with the common contact 14, and another contact arm to be separated from the transfer contact 16 when the operating rod 22 is depressed. The sliders 17 and 18 are biased upward by a pair of return springs 23 (only one of them is shown) extended between the lower surfaces of the sliders 17 and 18 and the lower wall of the case 11.

When the dual spring-return switch is in the OFF-state, the sliders 17 and 18 are pressed against the upper wall of the case 11 by the return springs 23, so that the common contact 14 is connected to the transfer contact 15 by the movable contact 19, and the common contact 14 is connected to the transfer contact 16 by the movable contact 20. When the operating rod 21 (22) is depressed against the resilience of the return spring 23, to lower the slider 17 (18) by a predetermined distance, the movable contact 19 (20) is separated from the transfer contact 15 (16) to disconnect the common contact 14 from the transfer contact 15 (16). The depression of the operating rod 21 can be detected through the detection of disconnection of the terminals 14*a* and 15*a*, the depression of the operating rod 22 can be detected through the detection of disconnection of the terminals 14*a* and 16*a*.

The spring-return switch shown in FIG. 7 is designed so that the second contact arm 6*c* comes into contact with the transfer contact 3 when the operating rod 4 is depressed axially by a predetermined distance. However, it occurs sometimes that the push rod 4 is depressed diagonally. Particularly, when the operating rod 4 is depressed in an inclined position as shown in FIG. 9 that increases the resistance of the inner surface of the side wall 1*b* against the sliding movement of the second contact arm 6*c*, the first contact arm 6*b* slides downward before the second contact arm 6*c* slides downward. Therefore, the operating rod 4 needs to be depressed by a distance exceeding the predetermined distance to bring the second contact arm 6*c* into contact with the transfer contact 3, which delays the switching operation of the spring-return switch greatly. Since the effective stroke of the operating rod 4 is dependent on the inclination of the operating rod 4, the switching performance of the spring-return switch is unreliable.

The spring-return switch shown in FIG. 8 has the clearance C between the slider 5 and the base portion of the movable contact 6 to intercept the transmission of the vibration of the slider 5 to the movable contact 6. Therefore, the movable contact 6 tends to tilt in one direction even if the operating rod 4 is depressed axially and hence it is difficult to time the switching operation of the spring-return switch correctly.

The dual spring-return switch shown in FIGS. 10 and 11 has the terminals 14*a*, 15*a* and 16*a* projecting from the outer surface of one of the longer side walls of the case 11. However, a desire to use a dual spring-return switch having three terminals projecting from the outer surface of one of the shorter side walls of the case has grown recently with the recent progressive increase in the packaging density of printed wiring boards with which the dual spring-return switch is to be used, because of many restrictions on the layout of components of printed wiring boards.

Dual spring-return switches previously proposed to meet such a requirement are shown in FIGS. 12 and 13, in which like or corresponding parts are denoted by the same reference characters.

The dual spring-return switch shown in FIG. 12 has a lower case 12 having opposite longer side walls 12*a* and 12*b*, and opposite shorter side walls 12*c* and 12*d*, a common contact 14 embedded in the inner surface of the longer side wall 12*a*, transfer contacts 15 and 16 separately embedded in the inner surface of the other longer side wall 12*b*, and terminals 14*a*, 15*a* and 16*a* buried in and projecting from the shorter side wall 12*c*. The extensions of the transfer contacts 15 and 16 are extended through the longer side wall 12*b* and connected respectively to the terminals 15*a* and 16*a*, and the extension of the common terminal 14 is extended through the other longer side wall 12*a* and connected to the terminal 14*a*. This construction needs the longer side wall 12*b* in a comparatively large thickness to secure satisfactory reliability of the dual spring-return switch, which, inevitably increases the size of the dual spring-return switch.

The dual spring-return switch shown in FIG. 13 has a substantially U-shaped common contact 14 having a first contact arm 14*b* to be in contact with a movable contact 19, and a second contact arm 14*c* to be in contact with a movable contact 20. The common contact 14 is disposed between the movable contacts 19 and 20 in a lower case 12 having opposite longer side walls 12*a* and 12*b* and opposite shorter side walls 12*c* and 12*d*. Transfer contacts 15 and 16 are embedded respectively in the inner surfaces of the opposite shorter side walls 12*c* and 12*d*. This construction requires a complex bending process of forming the common contact 14 in predetermined dimensions so that the common contact 14 is able to be in contact properly with the movable contacts 19 and 20 when a pair of operating rods 21 and 22 are arranged at a predetermined interval, which inevitably increases the cost of the dual spring-return switch.

SUMMARY OF THE INVENTION

Accordingly, it is a first object of the present invention to provide a spring-return switch capable of accurate switching operation without undesirable time lag.

A second object of the present invention is to provide a dual spring-return switch having terminals arranged so as to project from the outer surface of on one of the shorter side wall of a case, and capable of being formed in a comparatively small size and of being manufactured at a comparatively low cost.

In a first aspect of the present invention, a spring-return switch has a movable contact having a first contact arm in contact with a common contact and a second contact arm to be brought into contact with a transfer contact, and a slider holding the movable contact and integrally provided with a push rod having an axis dislocated from the center axis of the slider toward the second contact arm of the movable contact.

In a second aspect of the present invention, a dual spring-return switch comprises a case of a shape substantially resembling a rectangular cuboid, an entirely exposed common contact disposed within the case, a first transfer contact and a second transfer contact formed respectively on the opposite sides of the common contact, a first movable contact having a first contact arm in sliding contact with the common contact and a second contact arm to be brought into contact with the first transfer contact, a second movable contact having a first contact arm in sliding contact with the common contact and a second contact arm to be brought into contact with the second transfer contact, a first slider holding the first movable contact and supported on the case for vertical movement, a second slider holding the second movable contact and supported on the case for vertical movement, a first operating rod projecting upward from the first slider, a second operating rod projecting upward from the second slider, and return springs biasing the first and second sliders upward. The first operating rod has its axis dislocated from the center axis of the first slider toward the first transfer contact, and the second operating rod has its axis dislocated from the center axis of the second slider toward the second transfer contact.

When a pressure is applied to the operating rod of the spring-return switch in the first aspect of the present invention to depress the same, the greater part of the pressure acts on the second contact arm, so that the second contact arm can be lowered smoothly following the downward movement of the operating rod without delay.

In the dual spring-return switch in the second aspect of the present invention, the extension of the first transfer contact is buried in one of the shorter side walls of the case, the extensions of the common contact and the second transfer contact are buried respectively in the opposite longer side walls of the case, and all the terminals are projected from the shorter side wall in which the extension of the first transfer contact is buried. Accordingly, the side walls of the case may be formed in a comparatively small thickness. Although the first and second sliders are supported for vertical movement respectively on the opposite sides of the common contact at a comparatively small interval, the operating rods can be arranged at a specified interval because the operating rods are dislocated toward the first and second transfer contacts with respect to the centers of the corresponding sliders, respectively.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 1:
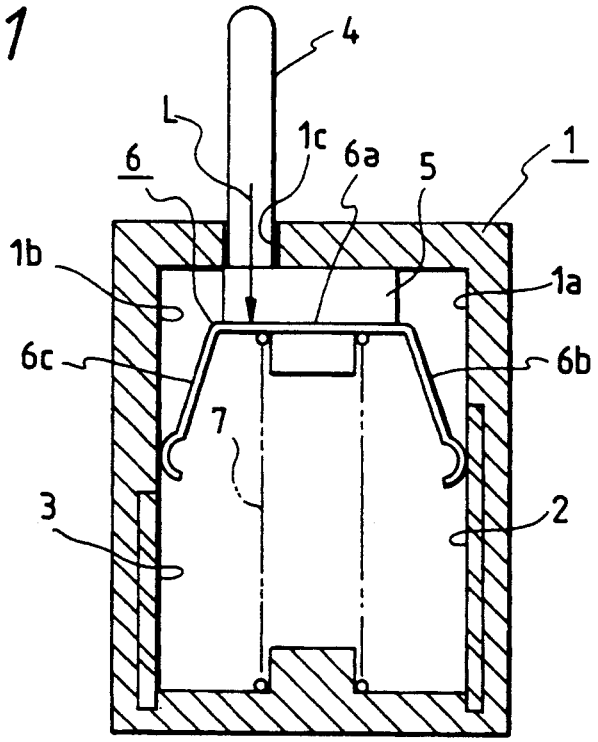
FIG. 1 is a sectional view of a spring-return switch in a preferred embodiment according to the present invention.

Preferred embodiments of the present invention will be described hereinafter with reference to the accompanying drawings, in which parts like or corresponding to those previously described with reference to FIGS. 7 to 13 are denoted by the same reference characters.

Figure 2:
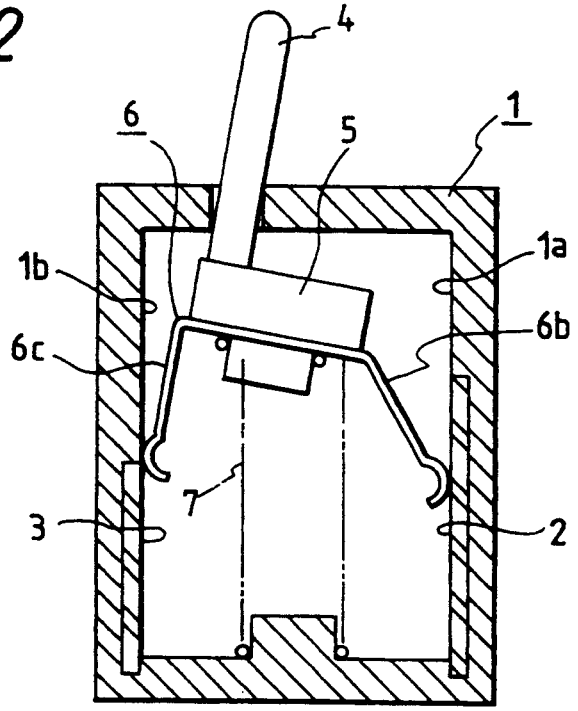
FIG. 2 is a sectional view of the spring-return switch of FIG. 1 in a switching state.

Referring to FIGS. 1 and 2, a spring-return switch in a first embodiment according to the present invention comprises a case 1, a common contact 2 embedded in the inner surface of one side wall 1*a* of the case 1, a transfer contact 3 embedded in the inner surface of the other side wall 1*b* of the case 1, a slider 5 supported for vertical movement within the case 1 and integrally provided with an operating rod 4 dislocated from the center of the slider 5 toward the transfer contact 3 and vertically extending from the upper surface of the slider 5 through a through hole 1*c* formed in the upper wall of the case 1, a movable contact 6 having a base portion 6*a*, a first contact arm 6*b* and a second contact arm 6*c*, and held by the slider 5 with the center of the base portion 6*a* thereof in alignment with the center of the slider 5, and a return spring 7 biasing the slider 5 upward so that the upper surface of the slider 5 is contiguous with the inner surface of the upper wall of the case 1 while the operating rod 4 is not depressed.

When the spring-return switch is in the OFF-state, where the operating rod 4 is not depressed, the first contact arm 6*b* of the movable contact 6 is in contact with the common contact 2, and the second contact 6*c* of the same is separated from the transfer contact 3.

When the operating rod 4 is depressed by an actuator, not shown, most part of the force exerted on the operating rod 4 indicated by the arrow L, which represents the line of action and the direction of the force, is exerted on the second contact arm 6*c*, because the distance between the second contact arm 6*c* and the line of action of the force is far greater than that between the first contact arm 6*b* and the line of action of the force. Therefore, the second contact arm 6*c* can be surely depressed even if the operating rod 4 is depressed somewhat diagonally. Accordingly, the second contact arm 6*c* moves exactly following the movement of the slider 5 and can be surely brought into contact with the transfer contact 3 without delay even if the operating rod 4 is depressed somewhat diagonally as shown in FIG. 2, which enhances the reliability of the switching action of the spring-return switch.

Figure 3:
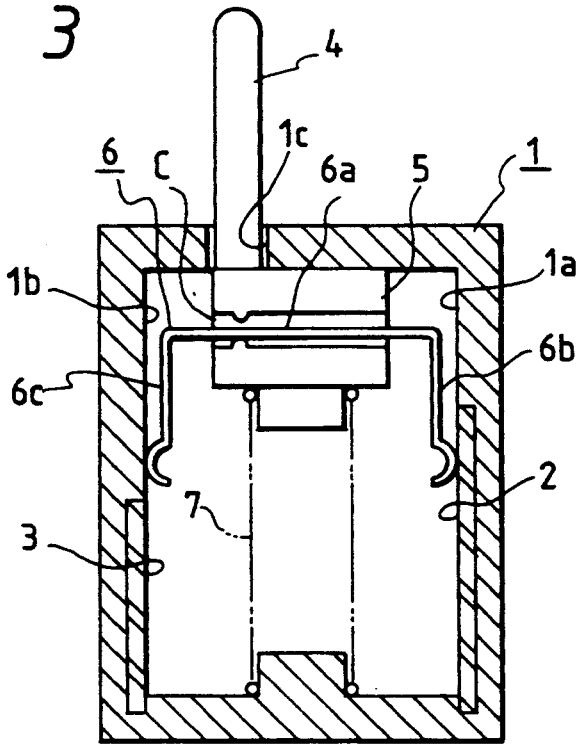
FIG. 3 is a sectional view of a spring-return switch in another embodiment according to the present invention intended for use on an automobile.
Figure 4:
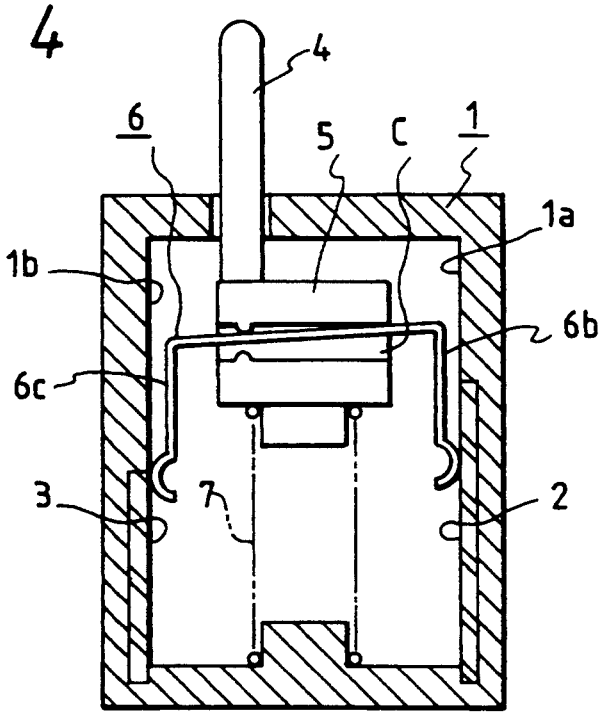
FIG. 4 is a sectional view of the spring-return switch of FIG. 3 in a switching state.

A spring-return switch in a second embodiment according to the present invention shown in FIGS. 3 and 4 is substantially the same in construction and function as the spring-return switch shown in FIGS. 1 and 2, except that the former incorporates an improvement intended to enhance the durability when used under vibratory condition.

Referring to FIGS. 3 and 4, the spring-return switch comprises a case 1, a slider 5 integrally provided with an operating rod 4, a movable contact 6 having a base portion 6*a* extending through the slot of the slider 5, a first contact arm 6*b* in continuous contact with a common contact 2, and a second contact arm 6*c* to be brought into contact with a transfer contact 3 when the slider 5 is depressed and a return spring 7 resiliently biasing the slider 5 upward so that the slider 5 is pressed against the inner surface of the upper wall of the case 1. The operating rod 4, similarly to the operating rod 4 of the first embodiment, is dislocated from the center of the slider 5 toward the second contact arm 6*c*.

Upper and lower ridges are formed respectively on the upper and lower surfaces of the slot of the slider 5. When the slider 5 is not depressed, the base portion 6*a* of the movable contact 6 rests on the lower ridge, and a clearance C is formed between the base portion 6*a* and the upper ridge, so that the vibration of the slider 5 is not transmitted to the movable contact 6. Thus, the unnecessary abrasion of the component parts can be obviated when the spring-return switch is used under vibratory condition.

In the spring-return switches in the first and second embodiments, the transfer contact 3 may be formed in the upper portion of the inner surface of the side wall 1*b* so that the second contact arm 6*c* of the movable contact 6 is in contact with the same to set the spring-return switch in the ON state when the slider 5 is not depressed and to see the spring-return switch in the OFF-state when the slider 5 is depressed.

Figure 5:
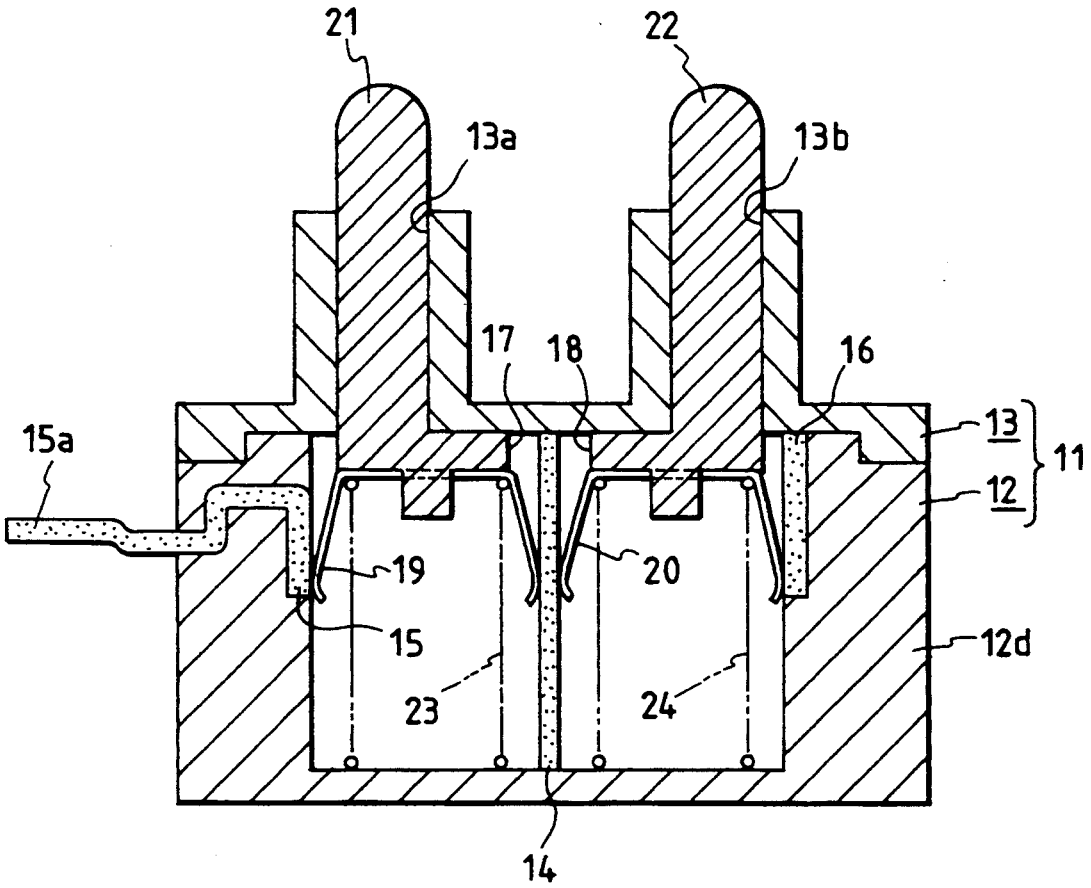
FIG. 5 is a sectional view of a dual spring-return switch in a third embodiment according to the present invention.
Figure 6:
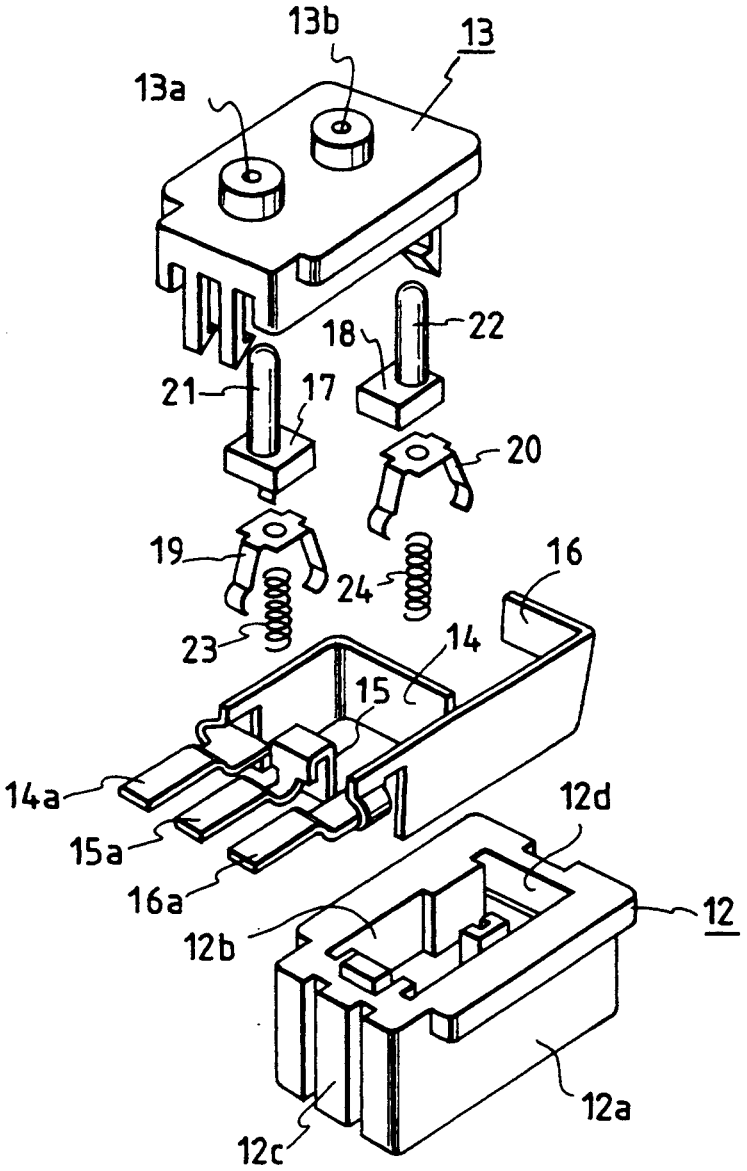
FIG. 6 is an exploded perspective view of the dual spring-return switch of FIG. 5.
Figure 7:
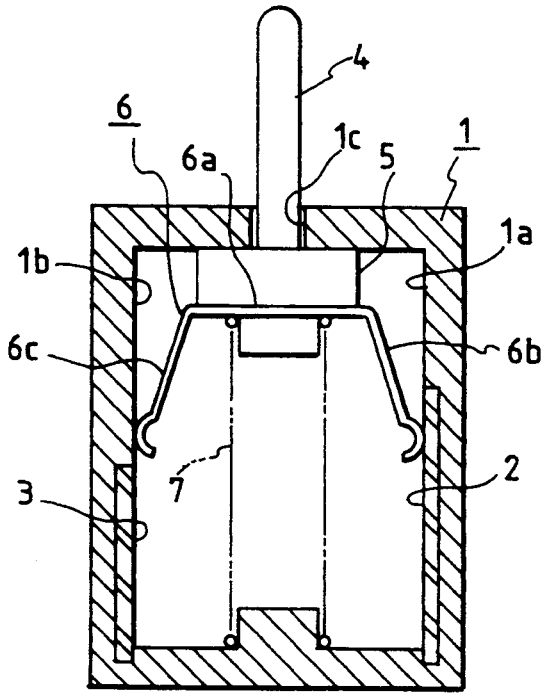
FIG. 7 PRIOR ART
FIG. 7 is a sectional view of a conventional spring-return switch.
Figure 8:
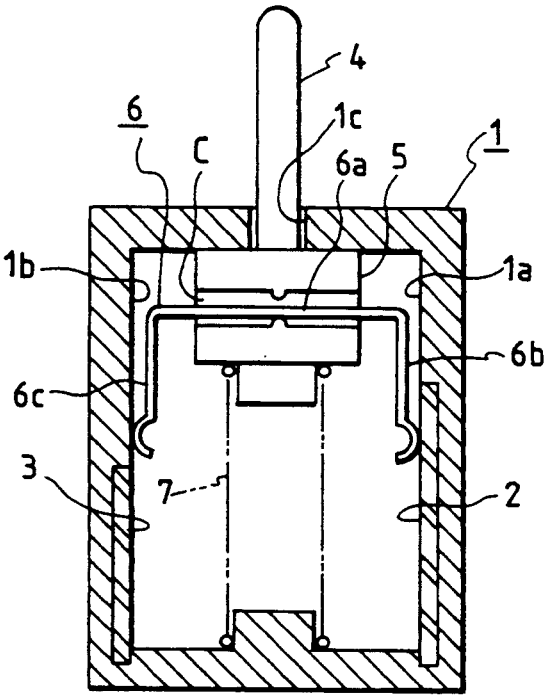
FIG. 8 PRIOR ART
FIG. 8 is a sectional view of another conventional spring-return switch.
Figure 9:
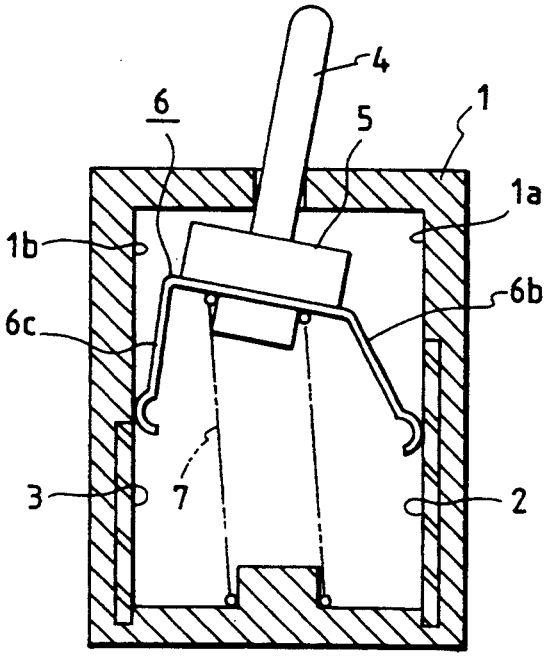
FIG. 9 PRIOR ART
FIG. 9 is a sectional view of the spring-return switch of FIG. 7 in a switching state.
Figure 10:
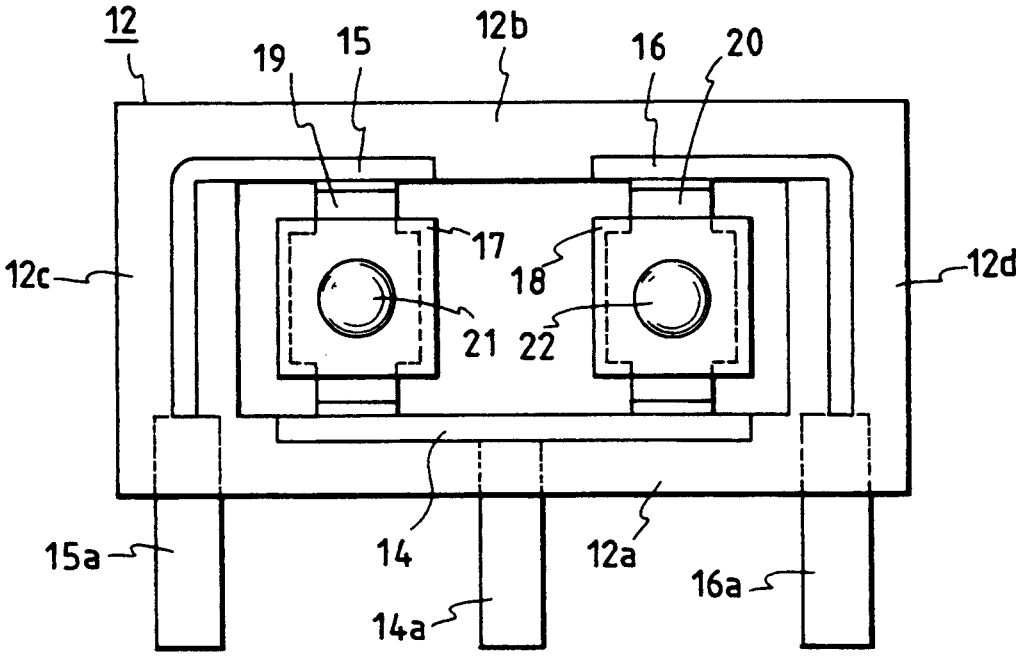
FIG. 10 PRIOR ART
FIG. 10 is a fragmentary plan view of a conventional dual spring-return switch.
Figure 11:
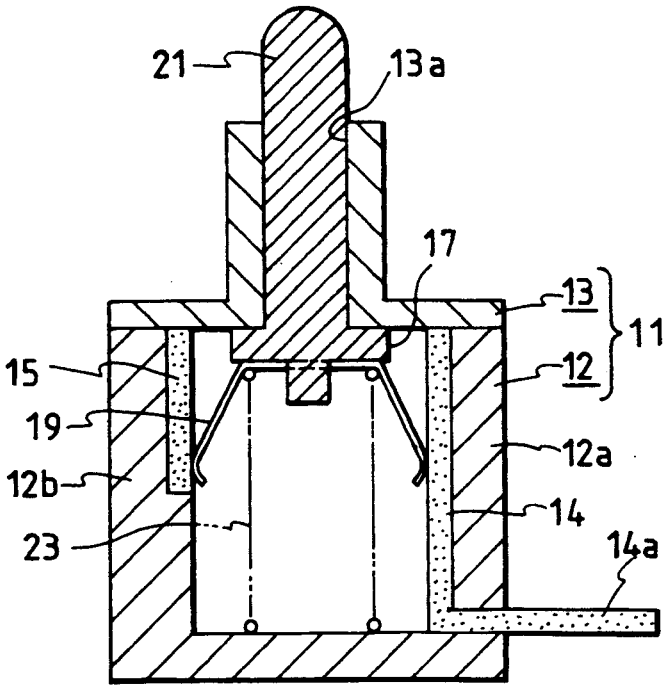
FIG. 11 PRIOR ART
FIG. 11 is a sectional view of the dual spring-return switch of FIG. 10.
Figure 12:
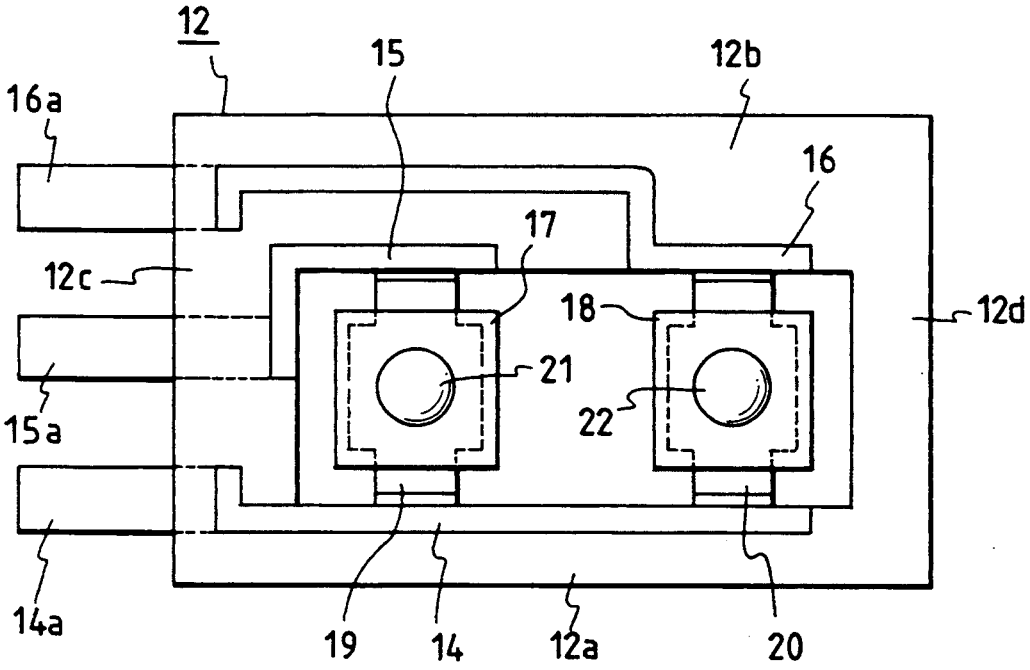
FIG. 12 PRIOR ART
FIG. 12 is a plan view of another conventional dual spring-return switch, in which an upper case-is removed.
Figure 13:
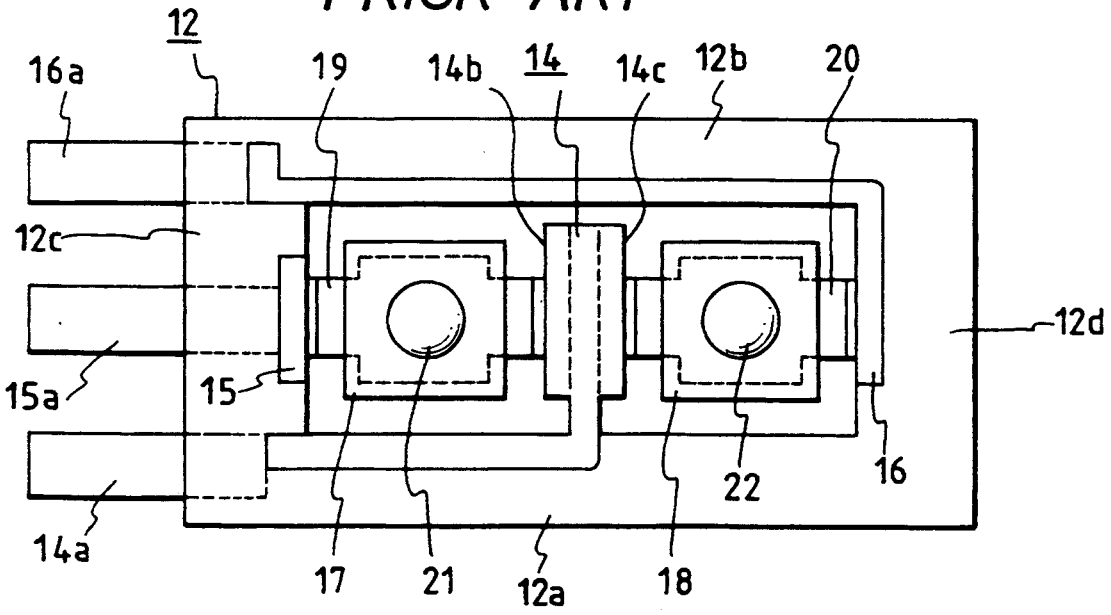
FIG. 13 PRIOR ART
FIG. 13 is a plan view of a third conventional dual spring-return switch, in which an upper case is removed.

Referring to FIGS. 5 and 6, a dual spring-return switch in a third embodiment according to the present invention comprises a case 11 of a shape substantially resembling a rectangular cuboid constructed by putting together a lower case 12 and an upper case 13, a common contact 14 formed by bending a flat metal plate and disposed at the middle of the lower case 12 with respect to the length of the same, a first transfer contact 15 embedded in the inner surface of one shorter side wall 12*c* of the lower case 12 opposite to one side of the common contact 14, a second transfer contact 16 embedded in the inner surface of the other shorter side wall 12*d* of the lower case 12 opposite to the other side of the common contact 14, a first slider 17 supported for vertical movement within the case 11 on one side of the common contact 14, a second slider 18 supported for vertical movement within the case on the other side of the common contact 14, a first movable contact 19 fixed to the first slider 17, a second movable contact fixed to the second slider 18, a first operating rod 21 formed integrally with the first slider 17 and dislocated from the center of the first slider 17 toward the first common contact 15, a second operating rod 22 formed integrally with the second slider 18 and dislocated from the center of the second slider 18 toward the second common contact 16, return springs 23 and 24 respectively biasing the first slider 17 and the second slider 18 upward so that the first slider 17 and the second slider 18 are pressed against the inner surface of the upper wall of the upper case 13, and terminals 14*a*, 15*a* and 16*a* extending respectively from the common contact 14, the first transfer contact 15 and the second transfer contact 16 and projecting from the outer surface of the shorter side wall 12*c* of the lower case 12.

The first movable contact 19 fixed to the first slider 17 has a first contact arm continuously in contact with the common contact 14, and a second contact arm in contact with and to be separated from the first transfer contact 15 when the first slider 17 is depressed. The second movable contact 20 fixed to the second slider 18 has a first contact arm continuously in contact with the common contact 14, and a second contact arm in contact with and to be separated from the second transfer contact 16 when the second slider 18 is depressed. The operating rods 21 and 22 are extended respectively through holes 13*a* and 13*b* formed in the upper case 13 at a specified interval and the extremities of the operating rods 21 and 22 are inserted in holes formed in an external device, not shown.

The common contact 14, first transfer contact 15 and the second transfer contact 16 are incorporated into the lower case 12 by insert molding so that the extension of the first transfer contact 15 is buried in the shorter side wall 12*c*, the extension of the second transfer contact 16 is buried in the longer side wall 12*a* and the extension of the common contact 14 is buried in the other longer side wall 12*b*.

The first slider 17, the first movable contact 19, the first operating rod 21, the first transfer contact 15 and the common contact 14 constitute a first switch unit, and the second slider 18, the second movable contact 20, the second operating rod 22, the second transfer contact 16 and the common contact 14 constitute a second switch unit.

When the sliders 17 and 18 are not depressed, the sliders 17 and 18 are pressed against the upper wall of the upper case 13 by the return springs 23 and 24, the common contact 14 is connected to the first transfer contact 15 by the first movable contact 19, and the common contact is connected to the second transfer contact 16 by the second movable contact 20. When pressure is applied to the first operating rod 21 to depress the first slider 17 by a specified distance against the resilience of the return spring 23, the second arm of the movable contact 19 is separated from the first transfer contact 15 to set the first switch unit in the OFF state. Thus, the depression of the first operating rod 21 can be detected through the detection of electrical disconnection of the terminals 14*a* and 15*a*. Similarly, the depression of the second operating rod 22 can be detected through the detection of electrical disconnection of the terminals 14*a* and 16*a*.

Since the extension of the first transfer contact 15 is buried in the shorter side wall 12*c* of the lower case 12, the extension of the second transfer contact 16 is buried in the longer side wall 12*a* of the lower case 12, the extension of the common contact 14 is buried in the longer side wall 12*b* of the lower case 12, and the terminals 14*a*, 15*a* and 16*a* project from the outer surface of the shorter side wall 12*c* of the lower case 12, the side walls of the case 11 may be formed in a comparatively small thickness, the dual spring-return switch can be formed in a comparatively small size without sacrificing the reliability.

Although the sliders 17 and 18 are disposed close to each other respectively on the opposite sides of the common contact 14 formed by bending a flat metal plate, the operating rods 21 and 22 can be arranged at a desired interval corresponding to the center distance between the holes of the associated external device by properly determining the distances of dislocation of the operating rods 21 and 22 from the respective centers of the corresponding sliders 17 and 18. Accordingly, the center distance between the sliders 17 and 18, hence the length of the case 11, and the shape of the common contact 14 need not be changed according to the center distance between the holes of the associated external device.

Since the operating rod 21 (22) is dislocated from the center of the slider 17 (18) toward the transfer contact 15 (16), most part of the pressure applied to the operating rod 21 (22) is exerted on the second contact arm of the movable contact 19 (20) and hence the second contact arm of the movable contact 19 (20) can be surely separated from the transfer contact 15 (16) without delay when the slider 17 (18) is depressed even if the operating rod 21 (22) is depressed somewhat diagonally, which enhances the reliability of switching performance of the dual spring-return switch.

The transfer contact 15 (16) may be formed in the lower portion of the shorter side wall 12*c* (12*d*) so that the second contact arm of the movable contact 19 (20) comes into contact with the transfer contact 15 (16) to set the switch unit in the ON-state when the operating rod 21 (22) is depressed.

Although the invention has been described in its preferred forms with a certain degree of particularity, obviously many changes and variations are possible therein. It is therefore to be understood that the present invention may be practiced otherwise than as specifically described herein without departing from the scope and spirit thereof.

What is claimed is:

1. A spring-return switch comprising:

a case having a lower wall, an upper wall, and first and second opposing side walls connected between the lower wall and the upper wall, the case defining a central axis extending between the upper wall and the lower wall, the central axis being centrally-located between the first and second side walls, the upper wall defining an opening which is located between the central axis and the first side wall;

a slider slidably supported within the case, the slider including an operating rod extending through the opening in the upper wall;

a movable contact connected to the slider and located within the case, the movable contact including a first arm contacting the first side wall, and a second arm contacting the second side wall; and a return spring having a first end connected to the bottom wall at a point intersected by the central axis, and a second end connected to the slider.

2. A spring-return switch according to claim 1 further comprising:

a first fixed contact located on an inner surface of the first side wall; and a second fixed contact located on an inner surface of the second side wall;

wherein the second fixed contact is positioned such that the second arm of the movable contact is constantly in sliding contact with the second fixed contact, and wherein the first fixed contact is positioned such that the first arm of the movable contact only contacts the first fixed contact when the slider is displaced away from the upper wall.

3. A dual spring-return switch comprising:

a case including:

a lower wall, an upper wall, first and second opposing side walls connected between the lower wall and the upper wall, and a central wall connected between the lower wall and the upper wall, the central wall being centrally-located between the first side wall and the second side wall, the case defining a first axis extending between the upper wall and the lower wall, the first axis being centrally-located between the first side wall and the central wall, the case defining a second axis extending between the upper wall and the lower wall, the second axis being centrally-located between the second side wall and the central wall, the upper wall defining a first opening which is located between the first axis and the first side wall, and the upper wall defining a second opening which is located between the second axis and the second side wall;

a first slider slidably supported within the case, the first slider including a first operating rod extending through the first opening;

a second slider slidably supported within the case, the second slider including a second operating rod extending through the second opening;

a first movable contact connected to the first slider and located within the case, the first movable contact including a first arm contacting the first side wall, and a second arm contacting the central wall;

a second movable contact connected to the second slider and located within the case, the second movable contact including a third arm contacting the second side wall, and a fourth arm contacting the central wall;

a first return spring having a first end connected to the bottom wall at a point intersected by the first axis, and a second end connected to the first slider; and a second return spring having a third end connected to the bottom wall at a point intersected by the second axis, and a fourth end connected to the second slider.

4. A spring-return switch according to claim 3 further comprising:

a first fixed contact located on an inner surface of the first side wall; and a second fixed contact located on an inner surface of the second side wall;

wherein the first fixed contact is positioned such that the first arm of the first movable contact contacts the first fixed contact only when the first slider is displaced away from the upper wall; and wherein the second fixed contact is positioned such that the third arm of the second movable contact only contacts the second fixed contact when the second slider is displaced away from the upper wall.

* * * * *